US005901529A

United States Patent [19]

Baur

[11] Patent Number: 5,901,529

[45] Date of Patent: May 11, 1999

[54] PROCESS AND EQUIPMENT FOR SHAPING AND PACKAGING A VISCOUS SUBSTANCE

[75] Inventor: Wilhelm Baur, Gestratz, Germany

[73] Assignee: Natec, Reich, Summer GmbH & Co. KG, Germany

[21] Appl. No.: 08/700,403

[22] PCT Filed: Jan. 6, 1996

[86] PCT No.: PCT/EP96/00036

§ 371 Date: Sep. 30, 1996

§ 102(e) Date: Sep. 30, 1996

[87] PCT Pub. No.: WO96/22224

PCT Pub. Date: Jul. 25, 1996

[30] Foreign Application Priority Data

Jan. 17, 1995 [DE] Germany ..... 195 01 106

[51] Int. Cl.[6] ..... B65B 61/24

[52] U.S. Cl. ..... 53/428; 53/122; 53/526

[58] Field of Search ..... 53/122, 127, 428, 53/440, 526

[56] References Cited

U.S. PATENT DOCUMENTS

| | | | |
|---|---|---|---|
| 2,134,862 | 11/1938 | Dunnam | 53/526 |
| 2,625,776 | 1/1953 | Brandenberger | 53/122 X |
| 2,759,308 | 8/1956 | Nawrocki | 53/122 X |
| 2,907,447 | 10/1959 | Offutt et al. | 53/526 X |
| 3,001,348 | 9/1961 | Rado | 53/550 |
| 3,300,944 | 1/1967 | Thesing | 53/552 X |
| 3,388,525 | 6/1968 | Thesing et al. | 53/552 X |
| 3,526,078 | 9/1970 | Dye | 53/526 |
| 3,542,570 | 11/1970 | Bush et al. | 53/451 X |
| 3,581,876 | 6/1971 | Keith | 53/526 X |
| 3,696,179 | 10/1972 | Jacobs | 53/122 X |
| 4,015,021 | 3/1977 | Harima et al. | 53/440 X |
| 4,133,162 | 1/1979 | Baumstingl | 53/450 |
| 4,262,473 | 4/1981 | Brooke | 53/450 |
| 4,543,769 | 10/1985 | Schmitz | 53/450 |
| 4,608,797 | 9/1986 | Shabram et al. | 53/550 X |
| 4,637,199 | 1/1987 | Steck et al. | 53/551 X |
| 4,731,250 | 3/1988 | Stark | 53/440 X |
| 4,792,457 | 12/1988 | Brna et al. | 53/440 X |
| 5,112,632 | 5/1992 | Meli et al. | 53/451 X |

FOREIGN PATENT DOCUMENTS

| | | |
|---|---|---|
| 3841945 | 7/1989 | Germany . |
| WO8200082 | 1/1982 | WIPO . |

*Primary Examiner*—Daniel B. Moon
*Attorney, Agent, or Firm*—Brown, Martin, Haller & McClain, LLP

[57] ABSTRACT

The invention relates to a process and a device for shaping and portioning a viscous compounds inside a flexible coating during a feed movement in which the compound inside the coating is deformed by forces acting from outside, the direction of which periodically changes. Here, the forces acting from outside act against the feed movement of the compound and its coating at least partially and for a certain time. In the device, the mass runs inside the coating between two shaping components (1, 2), preferably in the form of a toothed belt.

13 Claims, 3 Drawing Sheets

PROCESS AND EQUIPMENT FOR SHAPING AND PACKAGING A VISCOUS SUBSTANCE

The present invention relates to a method and apparatus for shaping a viscous substance within a pliable casing.

Similar devices for example are known in the field of food processing technology for portioning of cheese into slices and stacks. The presented innovation however does not only apply to cheese but also other materials that may not necessarily fall into the food processing area, but which have similar characteristics as cheese.

The substance being shaped will be funneled into a flexible casing. The mass is formed into a flat, plate-like condition by pinching the mass inside the wrapping at predetermined regions to bring the upper and lower surface of the wrapper into contact with each other. The wrapping is then fixed or sealed in the piched regions, so that the mass cannot flow back into its initial, continuous form.

There are two known procedures:

The substance may be shaped while still warm. Due to the high temperature this causes less friction and has a relative good free-flow. The re-shaping can therefore take place relatively easy. The problem however is that the setting has to take place quickly since the substance may flow back to the portion setting position, for example due to gravitational force. An additional problem is that the substance has not solidified and will change its shape in general during the cooling process. This results in shapes that are not very esthetic, since no set substance thickness has been achieved which causes problems during the transport and the packaging.

A second possibility is the deformation of the substance in rather cool condition which is described in DE 42 04 396. The viscosity of the material is much higher and more force is needed for the deformation. In addition due to the high viscosity a high release force of the substance has developed. As a result the substance may flow back to the portion setting points if the setting of the casing is not done immediately after the displacement.

This back-flow may cause big problems during the setting since the substance once again has to be displaced from the portion setting position. If the setting has not been completed or if it is not stable it may result in loosing the setting altogether and therefore may distribute the substance from its intended shape.

As a rule, both processes are using a control system, where the substance including the casing is transported in a controlled direction through a proper portion- and setting-device.

The purpose of the provided innovation is to achieve a reliable deformation during the cold-shaping process. This way a better and more reliable shaping as well as faster processing of portioning will be achieved.

The cold shaping process described in this innovation is a shaping process where the substance which has to be shaped has a rather high viscosity due to its low temperature. This temperature is approximately 10–14° C. for cheese.

The shaping method according to the present invention is carried out by applying a force to the wrapping, with the direction and/or amount of the force periodically changing. The change in force depends on the distance between each individual portion of the material being packaged, or the spacing between adjacent pinch regions, as well as the properties and thickness of the mass to be shaped, and the wrapping material. The forces act in such a way that the mass inside its wrapping is pinched out from the pinching or sealing region. The direction of pinching is preferably opposite to the feeding direction of the mass.

In the prior art method the casing was simply pressed together at the predetermined sealing or pinch regions separating adjacent portions. This new innovation utilizes outside influences to the casing which may change it's direction and amount periodically. The change depends on the distance between the portion setting points, the material data and the thickness of the substance and its casing. The mass within the casing will be displaced from the pinch regions, preferably in a direction opposite to the general direction of feed.

The biggest advantage of this influence is that the substance does not only get removed from the intended sealing regions but at the same time it will be removed from the marginal areas of the sealing or pinch regions. Even with this new innovation there will be restoring forces within the deformed substance, but these forces are distant from the sealing regions. For that reason there is no back flow of the mass into the sealing or pinch regions. The forces resulting from the elastic recovery of the mass which are acting on the pinch regions are also reduced, because the acting point of these forces is spaced relatively far away from the pinch regions.

The direction of the applied force opposite to the direction of feed of the substance is considered advantageous, since the substance to be shaped is already pressed forward in the direction of feed of the mass. If the pinching would take place in the same direction as the feed it would cause an interference of both motions and too much material would be collected at the pinch regions.

Of course it is possible to have these outside forces influence the substance and its casing not only once but several times and in several areas.

Because the forces are applied at several positions and the pinching of the mass occurs in the opposite direction to the feed direction, the production speed is increased.

As a rule the setting of the casing is done through a sealing process which takes place at a rather high temperature. Due to the corresponding production speeds the provided sealing rollers can not remain at the sealing regions very long during the first sealing process. Relative high temperatures can not be used, or the casing will melt or burn at its surface, while the inside surface may still be relatively cold. For that reason the pinching elements applying force to the casing are preferably heated, so that the mass is simultaneously displaced out of the sealing regions while the casing is preheated.

The new innovation will provide two shaping devices which will guide the substance in its pliable casing. The shaping devices are subjected to periodically changing forces.

Preferably two revolving belts with profile may be used. Of course instead of the belts, discs and rollers, or similar suited devices may be considered.

It is intended to have periodically changing forces applied to the shaping elements. This will be achieved, when the profiled belts are used in the center between the guide rolls. The forces may be applied through rolls, rams, hydraulic elements or similar objects.

It is important that during this process the belts or the shaping elements are loaded in a way that the substance is not only displaced from the sealing regions but that at the same time it will be pushed back opposite to the feed direction. Rollers or drums may be used to apply the force. This may be achieved through eccentric positioning of these rollers or drums, or use of a non-circular roller or drum. When using rams or hydraulic positioning elements these will be driven in a suitable, corresponding manner.

The force is applied such that the shaping element at first receives relatively little force which is directed substantially opposite to the feed direction and then transferred to the mass. Thus, the mass to be shaped is pinched out of the sealing region at the beginning of the pinching process.

The absolute forces may hereby remain the same or may change, and possibly increase.

The equipment may be laid out that during the first compression of the shaping element the forces will be relatively low so that the entire substance does not get displaced from the sealing or pinch region all at one time. This will be accomplished in a second, or if necessary in a third or fourth step. However of course it is also possible to complete the required pinching out of the mass to be shaped in one step, depending on the material characteristics.

As previously mentioned, the shaping elements preferably consist of rotating belts. The following description is only based on this implementation, whereas of course any other suitable design for the shaping element may be within the concept of the innovation.

Both belts used in the design as shaping elements will be equipped with spacers or cleats at a predetermined spacing on the side facing the substance. The clearance between the spacers and their height depends on the dimensions of the product being processed. The spacers themselves do not protrude without transition vertically from the belt surface, but have beveled or inclined edges and are essentially trapezoid in shape. Therefore the displacement of the substance from the pinch regions not occur suddenly, but the substance will be transported to the pinch regions somewhat tapered in the direction of the pinch regions. Through this specific shaping all occurring restoring forces will be reduced.

The inside of the belts is equipped with knobs or similar guide devices for the operation and transportation.

In addition it is anticipated to have the spacers heated. For this process the spacers are made of either metal with specific coating or metal rods embedded in the material of the belts. During constant rotation of the belts, the spacers with its metal elements attached, are passing a matching heating unit, for example an induction element. This way the spacers will be warmed up, which does not only displace the substance in the pinch regions, but at the same time the casing will somewhat be warmed up. It is no longer necessary to bring the complete casing with relative low temperatures to a sealing temperature in a sealing unit, since the casing is already at a higher temperature. This way a reliable sealing is achieved with relative little expense.

Of course there are other ways to seal the casing so that the heating unit is not necessarily part of the innovation.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

Depicted are.

DESCRIPTION OF THE PREFERRED EMBODIMENT

Figure 1:
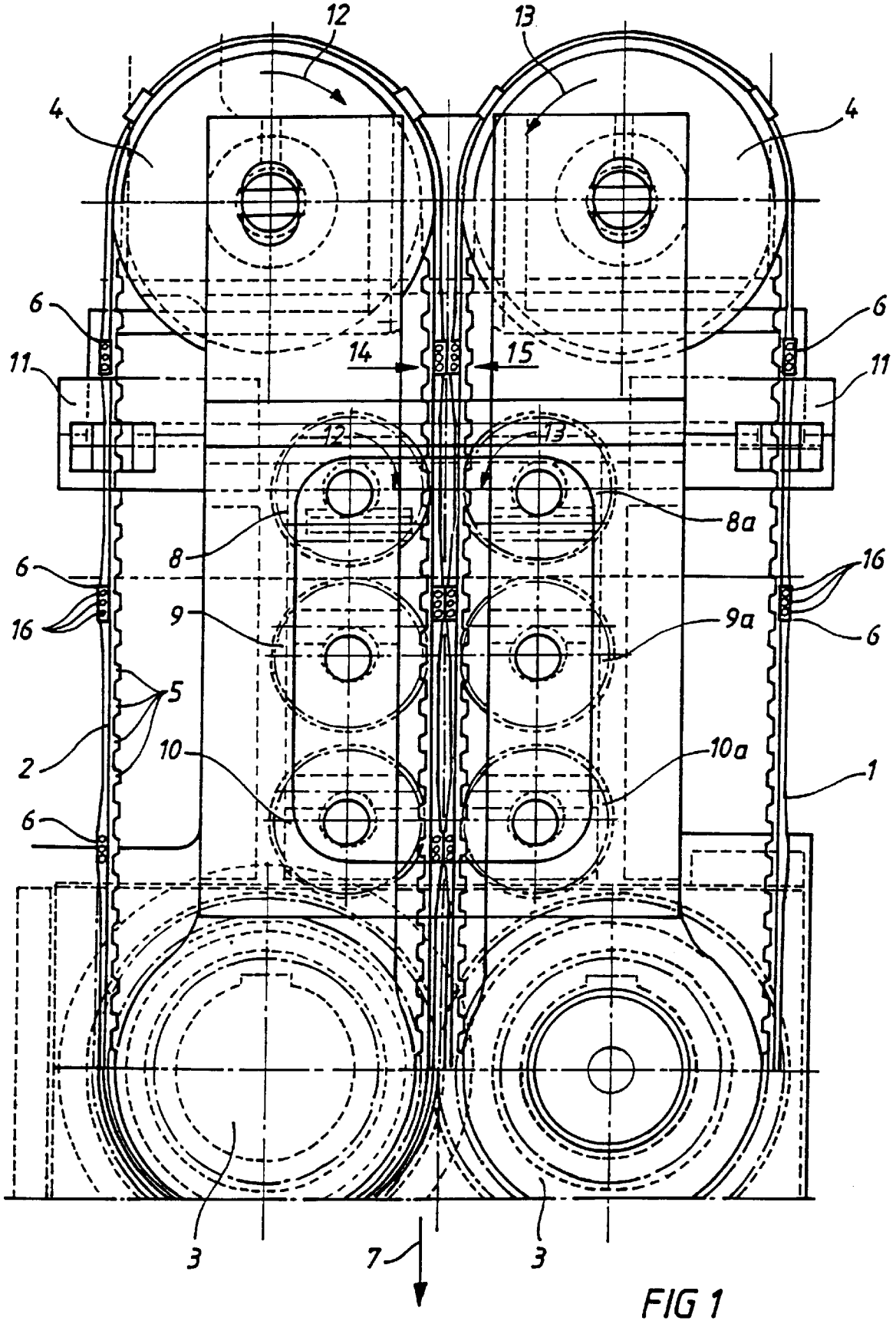
FIG. 1: Plan view of a schematic drawing of the displacement equipment according to the innovation.

FIGS. 1 to 4 illustrate a shaping apparatus according to a preferred embodiment of the present invention. As illustrated in FIG. 1, two belts 1, 2 are provided which rotate in the direction of the arrows 12, 13 and are being guided by rollers 3, 4. This is done through sprockets 5, which are located on the inside of belts 1, 2. Rollers 3, 4 are designed in a way that they engage the sprockets 5 to drive belts 1, 2. Belts 1, 2 are equipped with several spacers 6 on the outside, where each spacer 6 has one or more rods or bars 16 attached.

Belts 1, 2 are synchronized so that the spacers 6 of both belts are opposite each other as shown in FIG. 1.

The entire unit should be equipped that the substance that needs to be shaped is being transported vertically downward in direction of the feed 7. Of course any other installation position is possible, for example horizontal or diagonal, and the feeding direction may be upwards, opposite to the gravitational forces.

Figure 2:
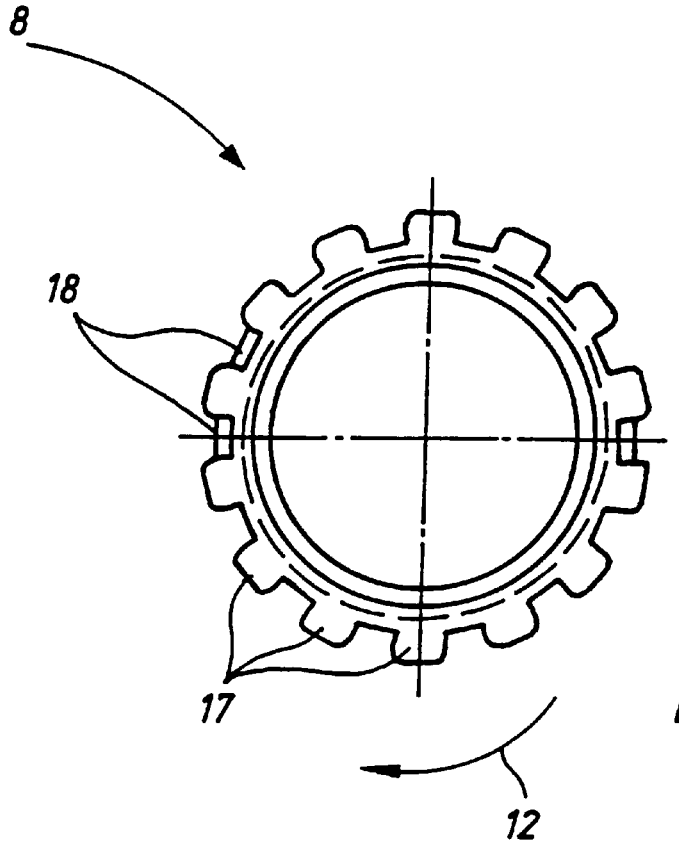
FIG. 2, 3: Side view of rollers used for the displacement.
Figure 3:
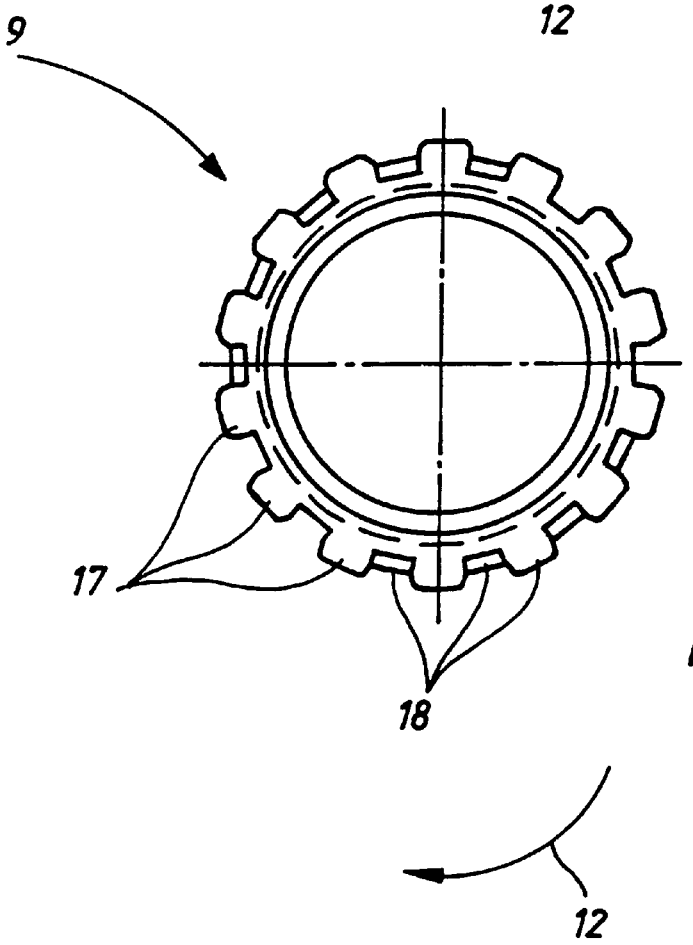

In the area between the rollers 3, 4, as shown in the example, three sets of rollers 8, 8*a*, 9, 9*a*, 10, 10*a*, are provided, which have a surface equipped with sprockets 17 (FIG. 2, 3).

The substance that needs to be shaped and portioned, together with the casing, is now ready to be filled into the funnel from the top in direction of arrow 7. This funnel is located between belts 1, 2. The belts will transport the substance in direction of arrow 7, until it reaches the area of the first set of rollers 8, 8*a*.

All sets of rollers 8, 8*a*, 9, 9*a*, 10, 10*a* are coupled rotationally synchronous with belts 1, 2 through their sprockets 17 (FIG. 2, 3). This way the force from the rollers to the belts may be measured so that there will always be a definite force present when the spacers 6 arrive at a predesignated position.

The rollers 8, 8*a*, 9, 9*a*, 10, 10*a* create a force in direction of arrow 14, 15 as well as in the opposite direction of the transport direction 7. This force is applied by inserts 18 between the teeth 17 of the roller-sets 8, 8*a*, 9, 9*a*, 10, 10*a* according to FIGS. 2, 3. These inserts may be squeezed in between the teeth, welded in or secured in any other way.

The height of the inserts 18 will be chosen so that either a complete compression of the spacers 6 in the area of the roller-sets occurs, or like at the first set of rollers 8, 8*a* (FIG. 2) that there may be some slack between spacers 6 of belts 1, 2. The force in direction of arrows 14, 15 in FIG. 1 derives from inserts 18. The space between rollers of each roller-set 8, 8*a*, 9, 9*a*, 10, 10*a* will be reduced and therefore the belts in-between will be pressed together, together with the cheese substance and the packaging. The springback effect opposite the direction of arrow 7 occurs as soon as the inserts 18 coincide with belts 1, 2. This contact occurs in FIG. 1 above the center of rollers 8, 8*a*. When the belts 1, 2 continue to move in direction of arrow 12, 13 and therefore move rollers 8, 8*a*, the inserts 18 have more contact with belts 1, 2 and press them together harder accordingly. The contact point between the rollers 8, 8*a* and the belts 1, 2 travel together with the cheese substance and the casing in a downward direction. During the continuation of the travel however, the distance between the inserts 18 of the facing rollers 8, 8*a* will be reduced. Since inserts 18 are positioned in an outward tilted angle during their first contact position—this is in reference to the center of the unit—and will turn parallel during the transport motion, a spring-back of the cheese substance is the result, when using inserts 18 on the rollers 8, 8*a*.

The same process occurs at roller sets 9, 9*a*, 10, 10*a*, which have more inserts 18 than the first roller set 8, 8*a*. For example, the first roller-set 8, 8*a* causes only a pre-shaping, while the opposing spacers 6 do not collide, so that some cheese substance may remain at these pinch regions. The final displacement or pinching takes place through roller-sets 9, 9*a*, 10, 10*a*.

Eccentrically mounted roller sets may be used instead of the roller sets 8, 8*a*, 9, 9*a*, and 10, 10*a* with inserts 18. This also permits a periodically changing application force to be applied to the belts 1, 2.

The roller sets are preferably adjustable in the direction of arrow 14, 15 as well as the direction of arrow 7 and in the opposite direction, although the adjustable mounting is not illustrated in detailed.

Overall, this way the optimum match to various conditions has been achieved. In addition a simple replacement of belts 1, 2 and rollers 3, 4 may be done to make the equipment more versatile in general.

Figure 4:
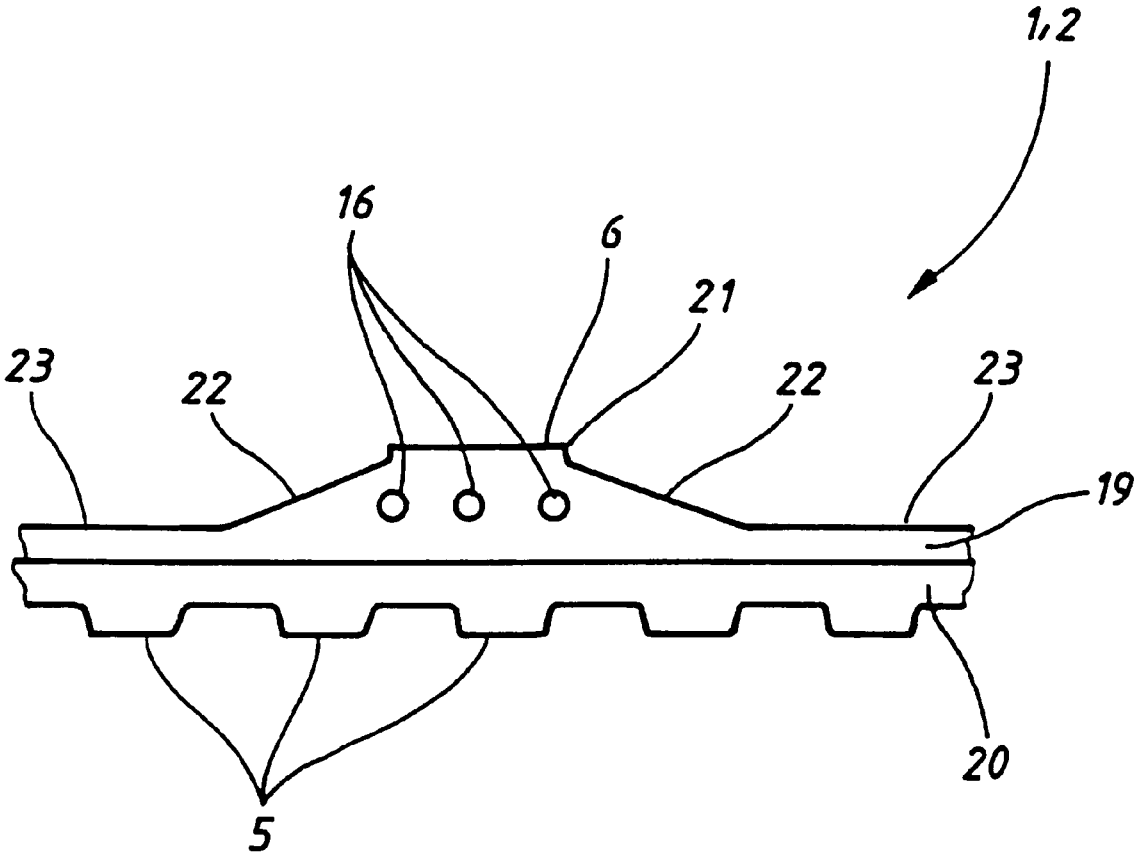
FIG. 4: Enlarged drawing of the displacement element.

FIG. 4 shows an enlarged drawing of the cross section of one of the belts 1, 2. The rods 16 are clearly shown which are located in the area of spacer 6 and are oriented transverse to the a longitudinal direction along belts 1, 2.

Of course as an alternative it is possible to insert a large rod or to design the entire spacer 6 in the shape of a metal part attached to the belt.

Through the aid of these rods 16 the spacer 6 will be heated. For this purpose each belt 1, 2 is equipped with an induction station 11 (FIG. 1). These induction stations provide the rods 16, which are equipped with electric-conductive material, with heat. Thus, the entire spacer region of the belts 1, 2, will be heated. Overall the casing will be pre-heated as soon as it gets in contact with the spacers 6 of belts 1, 2. This type of pre-heating is favorable in the areas of the pinch region.

As also shown in FIG. 4, each belt 1, 2 consists of surface material 19 as well as a base material 20 which is equipped with sprockets 5 and matching recesses. Of course it is also possible to use belts 1, 2 made of one continuous homogeneous material.

The spacer 6 is not designed to protrude in a vertical way from the surface 23 of the belts 1, 2, but has an offset 21, followed by a sloping 22. This is contrary to the present state of technology. This step is followed by an inclined surface 22, followed by a flat surface 23, which is substantially parallel to the longitudinal axis of the belts.

The inclined surface 22 will cushion the pinching process in the pinch regions, so that the pinching is not as abrupt as it was in prior art arrangements.

The subject matter of the presented innovation therefore assures reliable shaping by applying this cold-shaping-process.

Legend of Drawings

1 Belts
2. Belts
3. Roller
4. Roller
5. Sprocket
6. Spacer
7. Direction of arrow
8, 8*a* Set of rollers
9, 9*a* Set of rollers
10, 10*a* Set of rollers
11 Induction station
12. Direction of arrow
13. Direction of arrow
14. Direction of arrow
15. Direction of arrow
16. Rod
17. Sprocket
18. Insert
19. Surface material
20. Under material
21. Off-set
22. Sloping
23. Flat surface

I claim:

1. A method of shaping a viscous substance within a pliable casing into separate portions, comprising the steps of:

feeding a pliable casing containing a viscous substance in a feed direction between a pair of opposing belts traveling in the feed direction;

pinching spaced pinch regions of the casing between opposing pinch elements projecting from the belts as the casing moves along the feed direction so as to urge the viscous substance out of the pinch regions; and applying a variable force to the pinch elements as they travel in the feed direction, the force initially being applied in a direction opposite to the feed direction and subsequently being applied perpendicular to the feed direction to pinch the viscous substance from the spaced pinch regions in the casing.

2. The method as claimed in claim 1, wherein the force applied is initially a first, lower force and then increases to a higher force.

3. The method as claimed in claim 1, wherein several consecutive forces are applied to the pinch elements.

4. The method as claimed in claim 1, wherein the step of applying a variable force to the pinch elements as they travel along the feed direction comprises positioning spaced, opposing pairs of force-applying rollers to inner sides of the belts in the travel path, the rollers having a varying circumferential surface engaging the inner side of the belt so as to apply a varying force to any overlying pinch element as the rollers rotate relative to the belts.

5. An apparatus for shaping a viscous substance within a pliable casing into separate portions, comprising:

a pair of opposing belts with a gap between the belts defining a feed path for feeding a pliable casing containing a viscous substance between the belts;

spaced pairs of opposing pinch elements on the belts for pinching spaced regions of the casing to urge the viscous substance out of the spaced regions; and spaced force-applying means along the feed path for applying variable force to the pinch elements.

6. The apparatus as claimed in claim 5, wherein each pinch element has a raised surface extending substantially parallel to the respective belt and an inclined surface leading up to said raised surface.

7. The apparatus as claimed in claim 5, wherein each belt has an outer face and an inner face, and the force-applying means comprises a series of spaced, force-applying members acting against the inner face of each belt at spaced intervals along the feed path so as to apply a variable force to each pinch element as it travels along the feed path over the spaced, force-applying members.

8. The apparatus as claimed in claim 7, wherein each force-applying member comprises a roller having an outer circumference of varying radius.

9. The apparatus as claimed in claim 8, wherein each roller has teeth on its outer circumference for engagement with the respective belt, whereby the roller is rotated by movement of the belt, and has inserts between predetermined pairs of teeth which project radially outwardly from the outer circumference of the roller to provide said varying radius.

10. The apparatus as claimed in claim 7, wherein each force-applying member comprises a roller having an outer surface for acting on the belt to apply force to any overlying pinch element, the outer surface having raised portions for applying an increased force to the respective pinch elements, the rollers being arranged in spaced pairs along the feed path, and comprising at least a first and a second pair of rollers in the feed direction.

11. The apparatus as claimed in claim 10, wherein the first pair of rollers have fewer raised portions than the second pair of rollers, whereby the first pair of rollers apply less force to the pinch elements than the second pair.

12. The apparatus as claimed in claim 10, wherein the gap between the belts defines a central axis of the apparatus, and each raised portion is inclined in a diagonal outward direction relative to the central axis as the raised portion first contacts the belt, and subsequently extends parallel to the belt as the roller rotates with travel of the belt.

13. The apparatus as claimed in claim 5, including a heating device for heating the pinch elements.

* * * * *

UNITED STATES PATENT AND TRADEMARK OFFICE

CERTIFICATE OF CORRECTION

PATENT NO. : 5,901,529

DATED : May 11, 1999

INVENTOR(S) : Wilhem Baur

It is certified that error appears in the above-identified patent and that said Letters Patent is hereby corrected as shown below:

Column 1, line 16: Replace "piched" with –pinched--.

Column 3, after the first paragraph, add the following paragraph:

--As the displacement or pinching is continued, a larger force is applied in a direction perpendicular to the feed direction. The mass or substance will be forced away from the pinch region in a direction opposite to the feed direction.--

Column 3, line 29: Between "regions" and "not" add the word --does--.

Column 4, line 54: Replace "point" with --points--.

Column 5, line 12: Replace "detailed" with --detail--.

Column 5, line 33: Replace "region" with --regions--.

Column 5, line 40: Replace "offset" with --step--.

Column 5, line 41: Replace "a sloping" with --an inclined surface--.

Signed and Sealed this

Eleventh Day of January, 2000

*Attest:*

Q. TODD DICKINSON

*Attesting Officer*

*Acting Commissioner of Patents and Trademarks*